US007007665B2

(12) United States Patent
Yazaki et al.

(10) Patent No.: US 7,007,665 B2
(45) Date of Patent: Mar. 7, 2006

(54) OUTBOARD ENGINE

(75) Inventors: Makoto Yazaki, Wako (JP); Tomonori Ikuma, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/877,829

(22) Filed: Jun. 25, 2004

(65) Prior Publication Data

US 2004/0261768 A1 Dec. 30, 2004

(30) Foreign Application Priority Data

Jun. 25, 2003 (JP) ..... 2003-181794
Jun. 25, 2003 (JP) ..... 2003-181795

(51) Int. Cl.
*F02D 9/08* (2006.01)

(52) U.S. Cl. ..... 123/337; 123/376; 74/42

(58) Field of Classification Search ..... 123/337, 123/376, 400, 361; 74/42, 47, 51, 105, 469, 74/491

See application file for complete search history.

(56) References Cited

U.S. PATENT DOCUMENTS 5,638,783 A * 6/1997 Regueiro ..... 123/90.22
5,896,732 A * 4/1999 Dean ..... 56/13.7
5,899,280 A * 5/1999 Chouteau ..... 172/825
6,138,640 A * 10/2000 Asanuma et al. ..... 123/337
6,286,472 B1 * 9/2001 Takahashi et al. ..... 123/184.34
6,655,343 B1 * 12/2003 Suzuki et al. ..... 123/198 D
2001/0047776 A1 * 12/2001 Takahashi et al. ..... 123/58.1
2002/0179035 A1 * 12/2002 Suzuki et al. ..... 123/198 D

FOREIGN PATENT DOCUMENTS

JP 08-091297 4/1996
JP 11-034985 2/1999

* cited by examiner

*Primary Examiner*—John T. Kwon
(74) *Attorney, Agent, or Firm*—Carrier, Blackman & Associates, P.C.; Joseph P. Carrier; William D. Blackman

(57) ABSTRACT

An outboard engine has an internal combustion engine as a prime mover, a throttle valve device including a valve element and a valve shaft supporting the valve element, and combined with the internal combustion engine, a driven unit combined with the throttle valve device, and a drive unit for driving the driven unit. The drive unit is capable of smoothly transmitting an external throttle-operating force to the driven unit regardless of its position. A throttle valve operating mechanism connects an operating lever included in the driven unit, and a throttle-operating Bowden cable included in the drive unit. The throttle valve operating mechanism is a linkage including plural links. Joints joining the adjacent joining parts of those links are ball-and-socket joints, respectively. The valve shaft has one end connected to the operating lever and the other end connected to a throttle position sensor. The valve shaft is inclined to a horizontal plane.

10 Claims, 9 Drawing Sheets

OUTBOARD ENGINE

CROSS-REFERENCE TO RELATED APPLICATIONS

The present application claims priority under 35 U.S.C. 119, based on each of the following patent applications:

Japanese Patent Application No. 2003-181794, filed on Jun. 25, 2003;

Japanese Patent Application No. 2003-181795, filed on Jun. 25, 2003;

BACKGROUND OF THE INVENTION

1. Field of the Invention

The present invention relates to an outboard engine provided with an internal combustion engine having a throttle valve device capable of being easily operated from outside the outboard engine and of being neatly arranged inside an engine cover covering the internal combustion engine.

2. Description of the Related Art

A prior art outboard engine provided with an internal combustion engine and a throttle valve device combined with the internal combustion engine, and disclosed in JP 8-91297 A uses a push-pull cable, namely, a Bowden cable, for transmitting a throttle operating force to a driven part of the throttle valve device.

In the outboard engine disclosed in JP 8-91297 A, the inner cable of the Bowden cable is connected to a control lever disposed in a front part of the outboard engine, another cable is extended between a drive pulley combined with the control lever, and a driven pulley combined with the throttle valve device disposed in a rear part of the outboard engine. The inner cable of the Bowden cable is moved relative to the outer cable of the Bowden cable to turn the driven pulley in a desired direction for opening or closing the throttle valve device by the drive pulley.

Since the drive and the driven pulley respectively having certain diameters are used for transmitting the sliding motion of the inner cable of the Bowden cable to the valve shaft of the throttle valve device, a comparatively large space available for placing the drive and the driven pulley must be formed around the throttle valve device and hence the size of the engine cover needs to be increased.

In most conventional outboard engines, a vertical internal combustion engine is disposed with its crankshaft extended in a vertical position in a front part of the outboard engines, an intake duct connected to the intake port of the internal combustion engine is extended on the right or the left side of the internal combustion engine, and the intake duct and a throttle valve device connected to the intake duct are placed inside an engine cover covering the internal combustion engine. In the following description, terms qualifying directions and sides, such as right, left, front, rear, longitudinal and lateral, are used to qualify directions and sides with respect to the advancing direction of a ship provided with the outboard engine.

In most cases, a valve shaft holding the throttle valve of the throttle valve device is vertically extended, a throttle lever for turning the throttle valve has a base part connected to the upper or the lower end of the valve shaft and a free end connected directly or through links to an operating member, such as a push-pull wire.

In the outboard engine of this type, the valve shaft is supported in an upper bearing part and a lower bearing part, and water collects in the lower bearing part and, in some cases, the water collected in the lower bearing part hinders the light operation of the throttle valve device.

An outboard engine disclosed in JP 11-34985 A is provided with a throttle valve device having a throttle valve supported on a valve shaft, and placed in an intake duct with the valve shaft extended in a horizontal position.

In the outboard engine disclosed in JP 11-34985 A, a throttle lever connected to the valve shaft supporting the throttle valve, and a link connecting the throttle lever to a push-pull wire are arranged outside the intake duct, and a throttle position sensor for measuring the angular position of the throttle valve is connected to an outer end, lying outside the intake duct, of a shaft supporting a turning lever connecting the throttle lever and the push-pull wire. When the throttle lever, the link and the throttle position sensor are arranged outside the intake duct, the engine cover covering the internal engine of the outboard engine needs to be formed having a bulge and it is difficult to form the outboard engine in a compact construction.

The present invention has been made in view of the foregoing problems and it is therefore an object of the present invention to provide an outboard engine provided with a throttle valve device requiring a small space for installation, and a small engine cover that does not need to be formed having a bulge.

SUMMARY OF THE INVENTION

An outboard engine in a first aspect of the present invention includes: an internal combustion engine; a throttle valve device for controlling intake air to be taken in by the internal combustion engine; a driven unit combined with the throttle valve device; a drive unit for producing a throttle-driving force corresponding to an external throttle-operating force applied thereto; and a throttle valve operating mechanism for transmitting the throttle-operating force of the drive unit to the driven unit; wherein the throttle valve operating mechanism is a linkage including a plurality of component members, and the plurality of component members are joined by ball-and-socket joints.

In the outboard engine according to the present invention, the driven unit combined with the throttle valve device, and the drive unit capable of producing the throttle-operating force are interlocked by the throttle valve operating mechanism, and the throttle-operating mechanism is the linkage. Therefore, the throttle-operating force of the drive unit can be smoothly transmitted to the driven unit regardless of the distance between the drive unit and the driven unit.

Since the throttle-operating mechanism is a linkage, the throttle-operating force of the drive unit can be surely transmitted to the driven unit.

Since the throttle operating mechanism is a linkage, and the links of the linkage are joined by the ball-and-socket joints, respectively, the throttle-operating force of the drive unit can be surely transmitted to the driven unit regardless of the positional relation between the driven unit and the drive unit, and regardless of the difference between a direction in which the throttle-operating force of the drive unit acts and a direction from which the driven unit receives the throttle-operating force.

Preferably, the throttle valve device is disposed with the valve shaft inclined to a horizontal plane. The throttle valve device may be disposed such that the valve shaft slopes down from its front end toward its rear end.

When the throttle valve device is disposed in the foregoing position, collection of water in bearing parts supporting the valve shaft can be prevented and the throttle valve device can be lightly operated.

Preferably, the linkage including the throttle valve device is disposed such that the valve shaft slopes down from a front end thereof toward its rear end.

Preferably, the linkage includes a swing arm pivotally supported so as to be turned by the throttle-operating force of the drive unit, a bell crank, a link connecting the swing arm to the bell crank to transmit the swing motion of the swing arm to the bell crank, and a first connecting rod for transmitting motions of the bell crank to the driven unit.

Preferably, the arm, the bell crank and the link are supported on a single bracket.

Preferably, a second connecting rod for transmitting the throttle-operating force of the drive unit to the arm is longitudinally extended, and the first connecting rod for transmitting the motion of the bell crank to the driven unit is laterally extended.

Joints joining adjacent joining parts of the arm, the bell crank, the link and the two connecting rods may be ball-and-socket joints, respectively.

An outboard engine in a second aspect of the present invention includes: an internal combustion engine, an engine cover covering the internal combustion engine; and a throttle valve device disposed inside the engine cover and provided with a throttle valve for controlling intake air to be taken in by the internal combustion engine; wherein the throttle valve is supported on a valve shaft, a driven unit to be driven by an external throttle-operating force is combined with one end of the valve shaft, a throttle position sensor is combined with the other end of the valve shaft, and the valve shaft is inclined to a horizontal plane.

In this outboard engine, a dimension of the throttle valve along the valve shaft is small and the throttle valve device is compact and can be neatly disposed inside the engine cover.

Since the valve shaft of the throttle valve is inclined at a small angle to a horizontal plane, collection of water in bearing parts supporting the valve shaft can be prevented and the throttle valve device can be lightly operated.

The driven unit and the throttle position sensor combined with the opposite ends of the inclined valve shaft of the throttle valve can be inclined so as to be substantially parallel to the inclined surfaces and curved surfaces of the engine cover and can be disposed close to the engine cover covering the internal combustion engine. Consequently, the internal combustion engine can be neatly disposed inside the engine cover.

Preferably, the internal combustion engine has a crankshaft disposed in a crankcase on the front side of the center of the outboard engine with respect to the longitudinal direction, and the throttle valve device is disposed in front of the crankcase, and the valve shaft is extended along a longitudinal surface of the outboard engine.

Thus, the intake duct having one end connected to intake ports formed in a cylinder head on the rear side can be extended along either the right or the left side surface of the internal combustion engine and around the front side of the crankcase. Therefore, the engine cover does not need to be formed having a bulge, the intake duct can be formed having a long length, the outboard engine can be formed having compact construction, and intake efficiency can be improved.

DESCRIPTION OF THE PREFERRED EMBODIMENTS

The construction of an outboard engine 1 in a preferred embodiment of the present invention shown in FIGS. 1 to 12 will be described.

Figure 1:
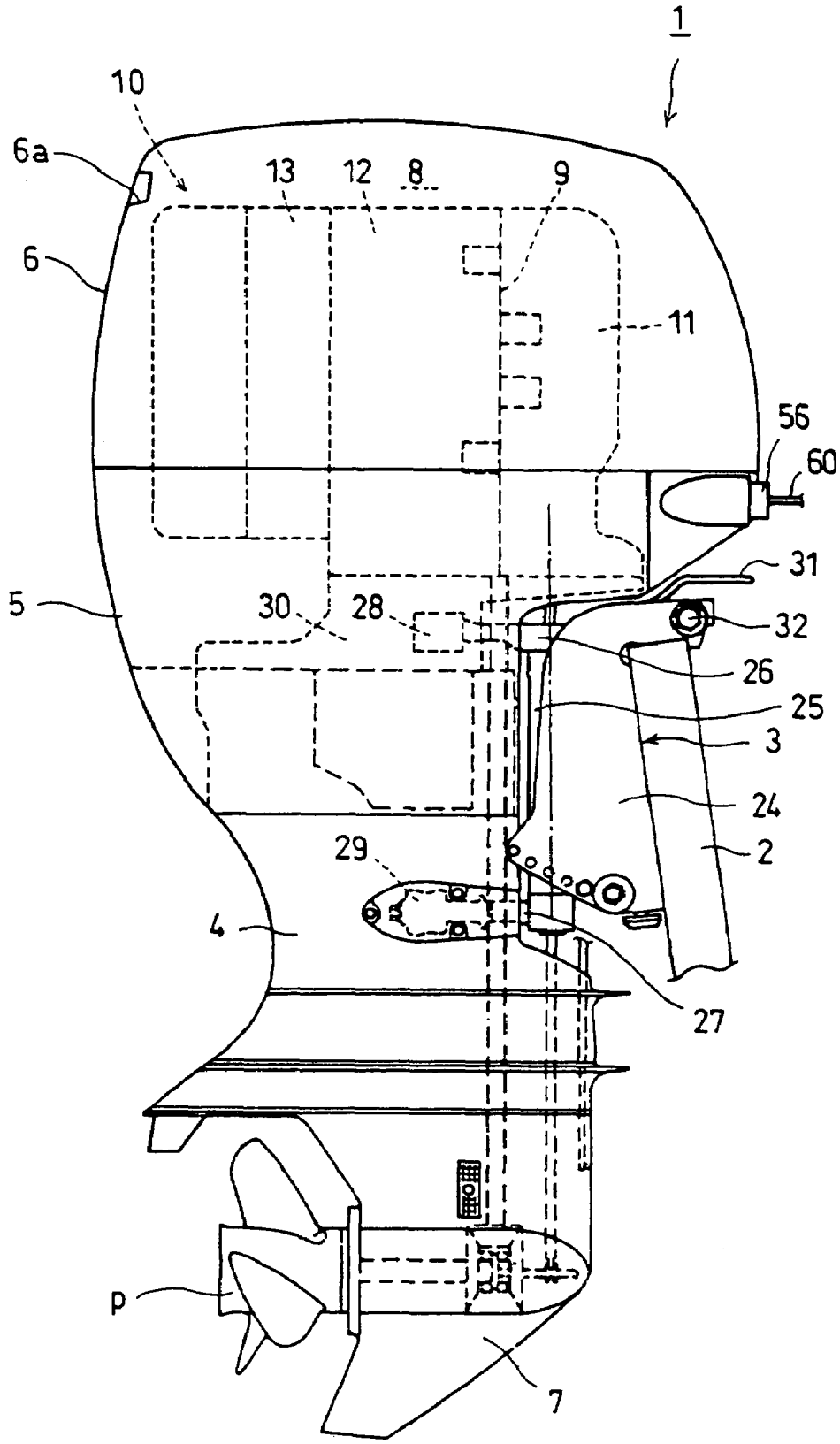
FIG. 1 is a side elevation of an outboard engine in a preferred embodiment according to the present invention taken from the right side of the outboard engine.

The front side of the outboard engine 1 on the side of a ship, i.e., the right side as viewed in FIG. 1, is supported by a support device 3 on the transom 2 of the ship. The outboard engine 1 has an extension case 4 covering a lower part of the outboard engine 1, an under cover 5 joined to the upper end of the extension case 4, and an engine cover 6 detachably joined to the upper end of the under cover 5. The engine cover 6 has an air intake opening 6*a*. A gear case 7 is joined to the lower end of the extension case 4. A propeller P extends rearward from the gear case 7.

Figure 4:
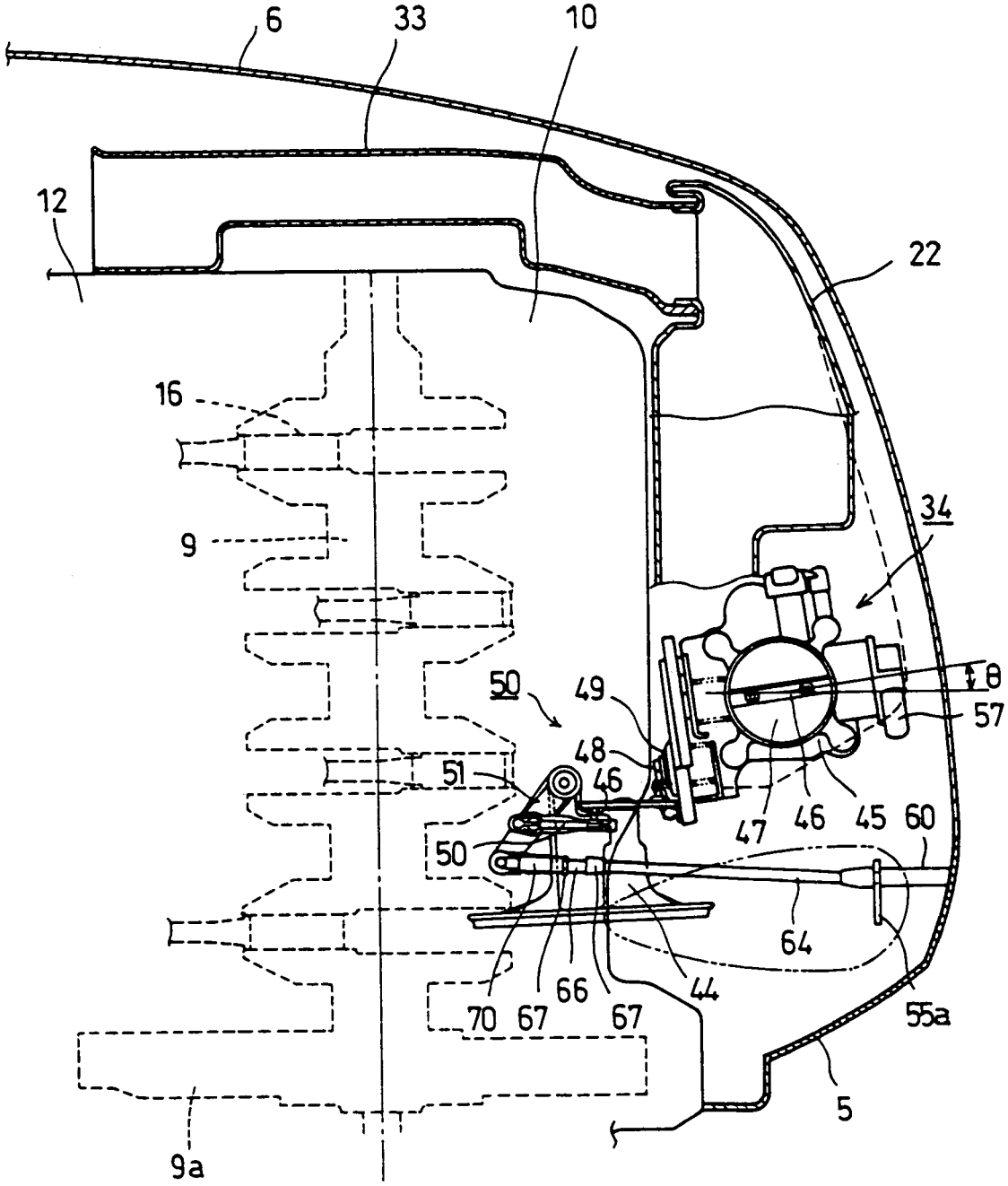
FIG. 4 is a fragmentary, longitudinal sectional view taken on the line IV—IV in FIG. 1.

An expanded upper part of the under cover 5 and the engine cover 6 define an engine chamber 8. An inline four-cylinder four-stoke-cycle internal combustion engine 10 and auxiliary machines are placed in the engine chamber 8. The internal combustion engine 10 is disposed with its crankshaft 9 extended in a vertical position. As shown in FIG. 4, a flywheel 9*a* is mounted on the lower end of the crankshaft 9.

Figure 2:
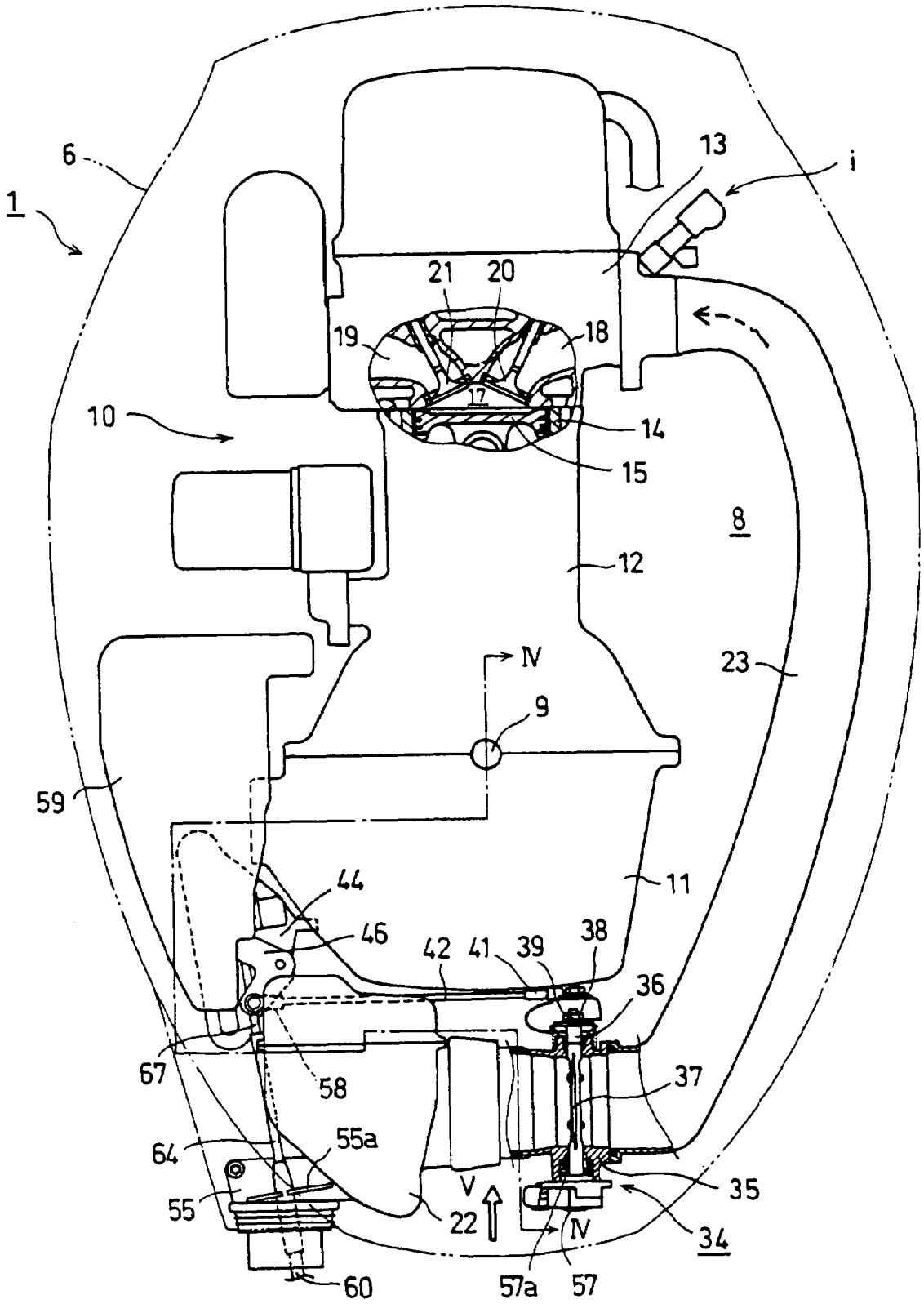
FIG. 2 is a partly cutaway plan view of the outboard engine shown in FIG. 1.

Referring to FIG. 1, the internal combustion engine 10 has a crankcase 11, a cylinder block 12 and a cylinder head arranged in that order rearward and joined together. The crankshaft 9 is supported for rotation between the joining surfaces of the crankcase 11 and the cylinder block 12. The cylinder block 12 is provided with four cylinders 14 in a vertical arrangement. As shown in FIG. 2, pistons 15 are fitted in the cylinders 14 for longitudinal, sliding reciprocation, and are connected to the crankshaft 9 by connecting rods 16 (FIG. 4) to drive the crankshaft 9 for rotation.

As shown in FIG. 2, ignition plugs, not shown, are attached to the cylinder head 13 so as to be exposed to combustion chambers 17 defined by the cylinders 14, the pistons 15 and the cylinder head 13, respectively. An intake port 18 and an exhaust port 19 for each of the cylinders 14 are formed in a lateral arrangement in the cylinder head 13 so as to open into the combustion chamber 17. An intake valve 20 and an exhaust valve 21 are seated on the inner open ends, on the side of the combustion chamber 17, of the intake port 18 and the exhaust port 19 of each cylinder 14, respectively. A fuel injection valve, not shown, is placed in the intake port 18. The intake valves 20 and the exhaust valves 21 are opened and closed by valve trains, not shown.

An intake vessel 22 defining an intake chamber is disposed in an upper right-hand region (a right region in FIG. 2) of a front part of the engine chamber 8. The inlet ends (right ends in FIG. 2) of the intake ports 18 are connected through an intake manifold 23 and a throttle valve device 34 to the intake box 22. A fuel injector i is provided at the downstream end of the intake manifold 23. The intake box 22 is opened through an intake duct 33 into the atmosphere as shown in FIG. 4.

The support device 3 has a main support 24 including a swivel case 25. A shaft, not shown, attached to a mount frame is supported for turning in a horizontal plane on the swivel case 25. An upper mount frame 26 of the mount frame is connected to a mount case 30 formed integrally with a lower part of the internal combustion engine 10 by an upper mount rubber 28. A lower mount frame 27 of the mount frame is attached to the extension case 4 by a lower mount rubber 29. A steering arm 31 formed in the mount frame is turned in a horizontal plane to turn the outboard engine 1 laterally for steering on the swivel case 25.

The main support 24 is supported on the transom 2 by a horizontal tilt shaft 32 and can be turned in a vertical plane on the tilt shaft 32.

Figure 3:
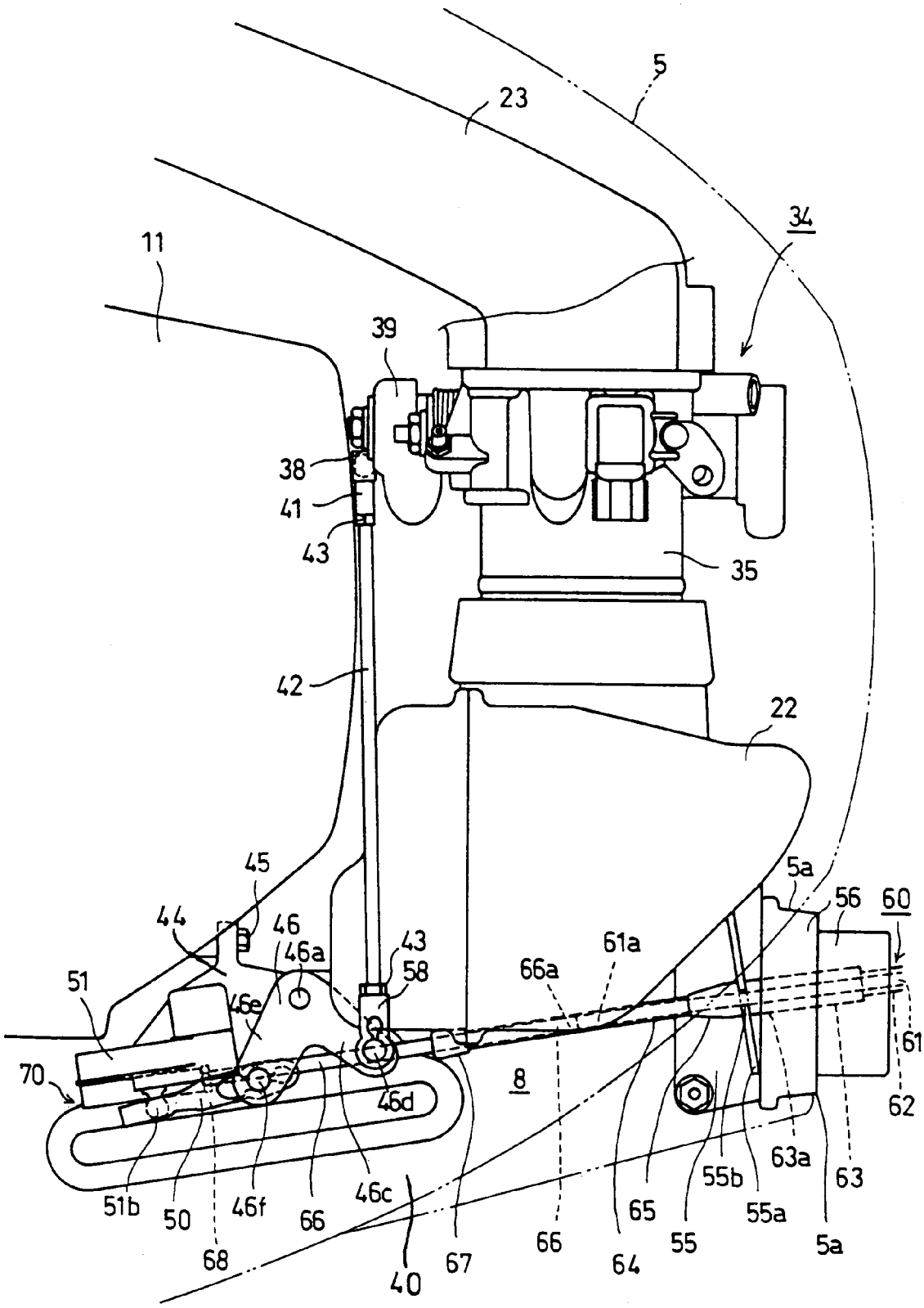
FIG. 3 is an enlarged plan view of an essential part of the outboard engine shown in FIG. 1.

Referring to FIGS. 2 and 3, the throttle valve device 34 has a cylindrical valve case 35, and a longitudinal valve shaft 36 supported for turning on the valve case 35. The valve shaft 36 is slightly inclined at an angle θ (FIG. 4) to a horizontal plane such that its front end is at a level higher than that of its rear end. The throttle valve device 34 has a disk-shaped valve element 37 attached to the valve shaft 36, an operating lever 38 supported for turning on a rear part of the valve case 35, and an interlocking mechanism 39 interlocking the valve shaft 36 and the operating lever 38. The interlocking mechanism 39 turns the valve shaft 36 such that a turning angle through which the operating lever 38 needs to be turned to turn the valve element 37 through a unit angle when the valve element 37 is near its fully closed position is greater than a turning angle through which the operating lever 38 needs to be turned to turn the valve element 37 through the same unit angle when the valve element 37 is near its fully open position. A throttle position sensor 57 is disposed on a front part of the valve case 35. The front end of the valve shaft 36 is connected to a movable member 57*a* of the throttle position sensor 57.

Although the interlocking mechanism 39 in this embodiment is a cam mechanism, the interlocking mechanism 39 may be any suitable mechanism, such as a linkage or an elliptic-gear mechanism, provided that the mechanism has the same characteristics as the interlocking mechanism 39.

A throttle valve operating mechanism 40 for operating the throttle valve device 34 will be described.

Figure 5:
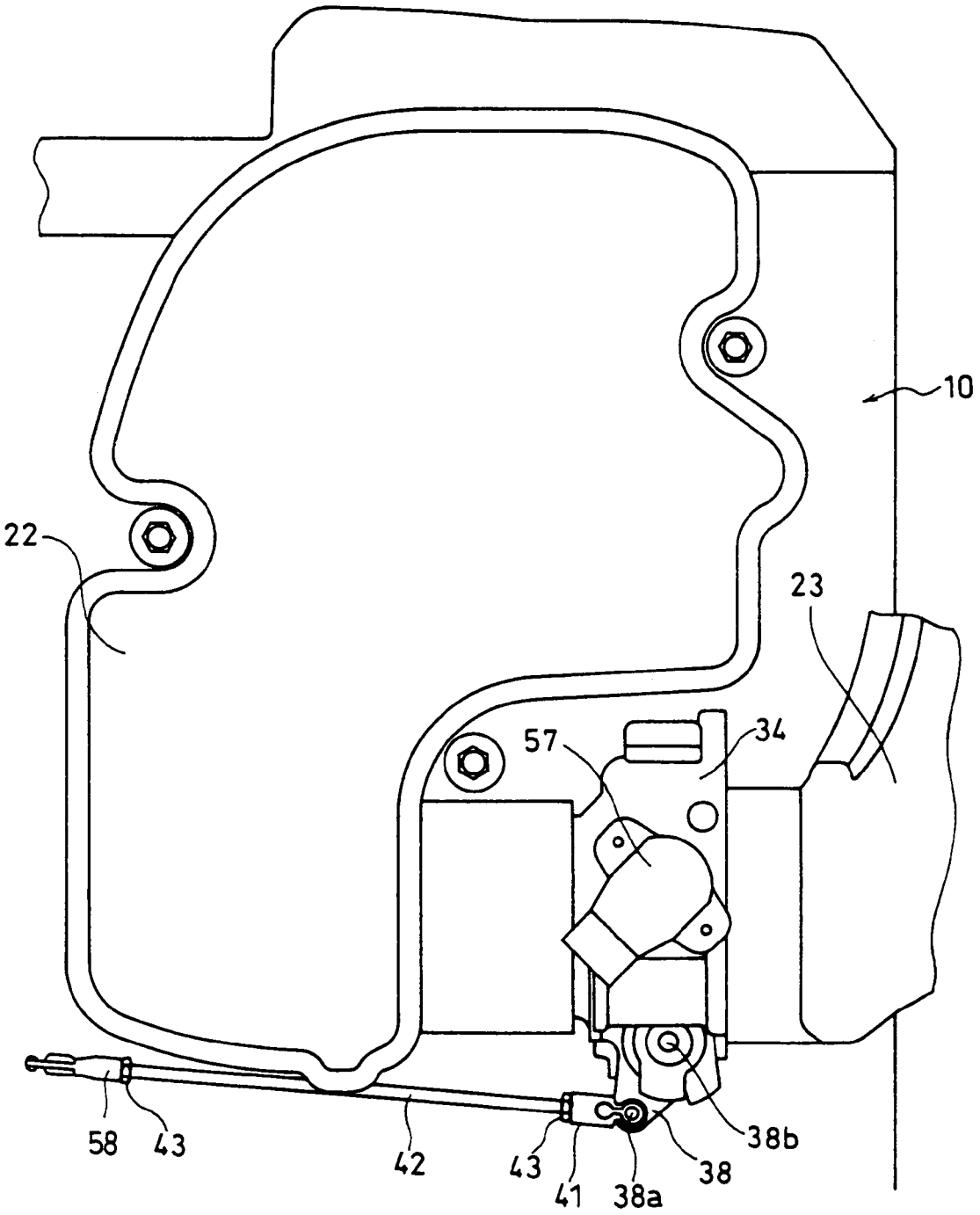
FIG. 5 is a view taken in the direction of the arrow V in FIG. 2.
Figure 12:
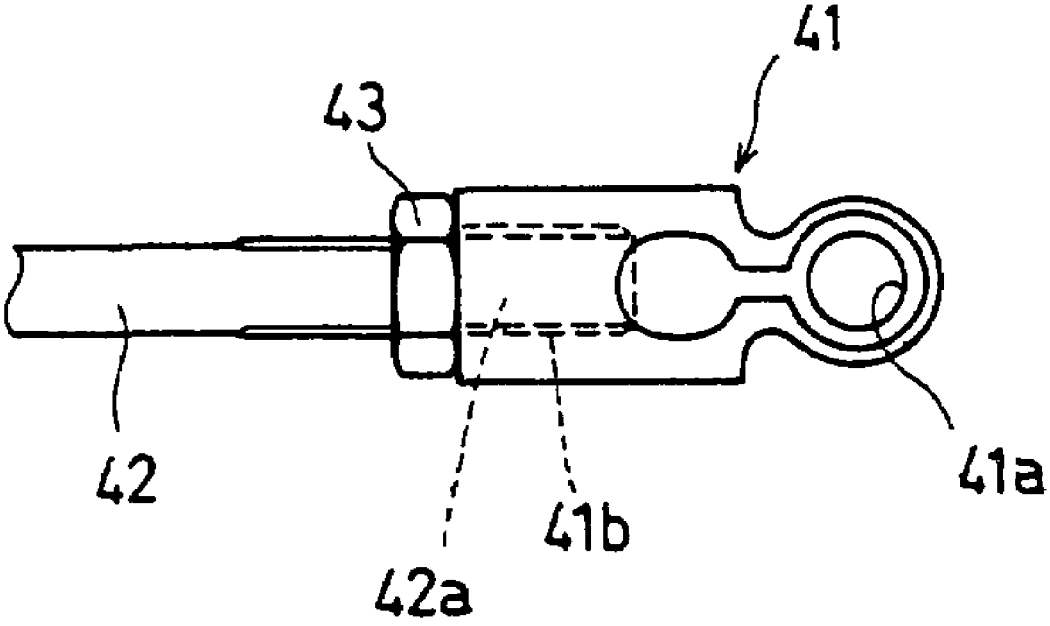
FIG. 12 is a plan view of a joint for a connecting rod.

Referring to FIG. 5, the operating lever 38 of the throttle valve device 34 is provided at its free end with a ball-ended connecting member 38*a*. The ball-ended connecting member 38*a* deviates from a shaft 38*b* on which the operating lever turns. The ball of the ball-ended connecting member 38*a* is engaged in a socket 41*a* of a socket-ended connecting member 41 provided with an internally threaded hole 41*b* (FIG. 12). The ball of the ball-ended connecting member 38*a* and the socket 41*a* constitute a ball-and-socket joint. An externally threaded part 42*a* of a rod 42 is screwed in the internally threaded hole 41*b*, and a locknut 43 put on the externally threaded part 42*a* is screwed down firmly against the end of the socket-ended connecting member 41 to connect the socket-ended connecting member 41 securely to the left end of the rod 42. The socket-ended connecting member 41 is able to turn in all planes passing the center of the ball of the ball-ended connecting member 38*a* attached to the free end of the operating lever 38. As shown in FIGS. 2 and 3, a socket-ended connecting member 58 similar to the socket-ended connecting member 41 is attached to the right end of the rod 42.

Figure 6:
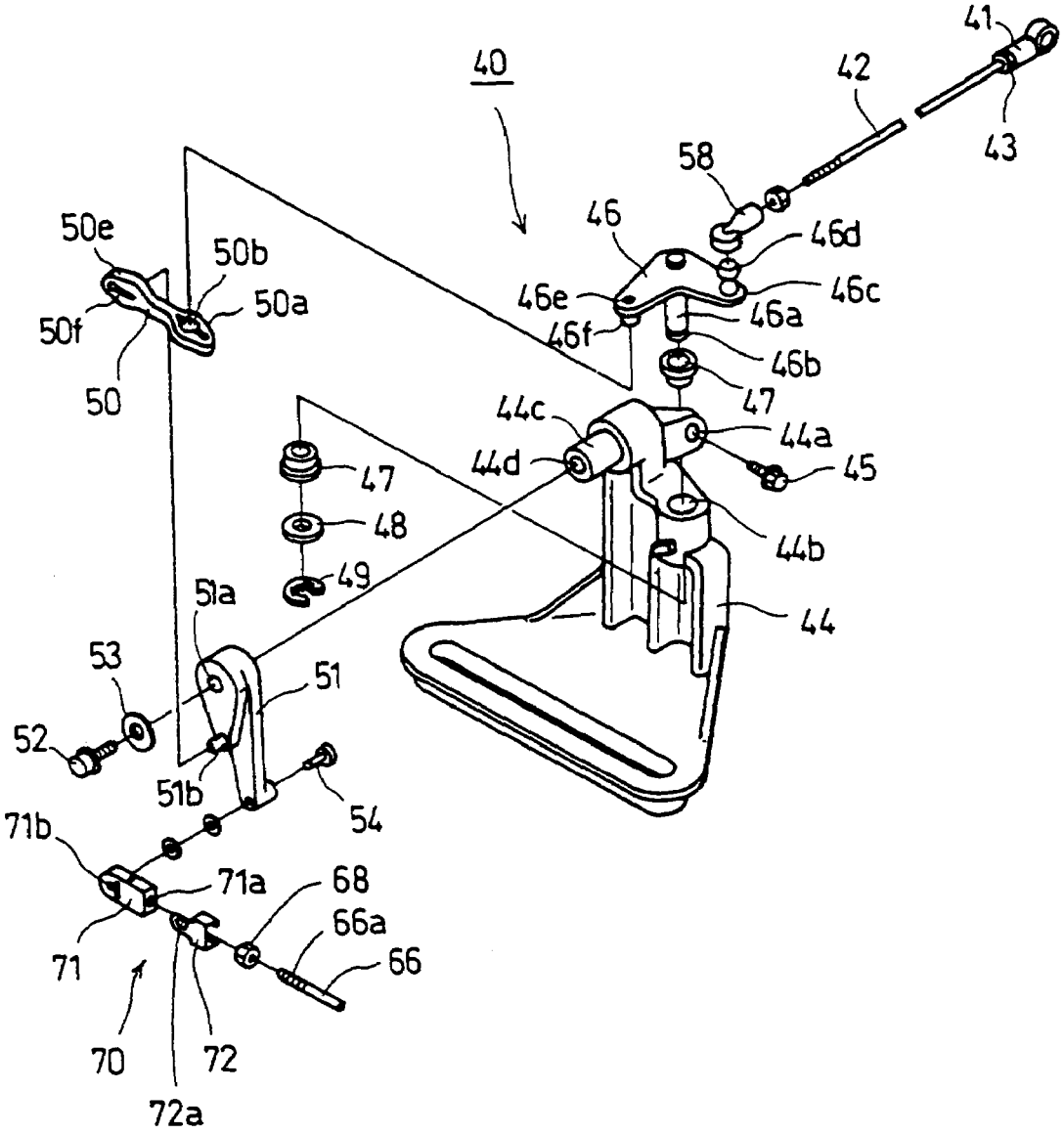
FIG. 6 is an exploded perspective view of a throttle-operating mechanism.

Referring to FIGS. 3 and 6, a bracket 44 is fastened to the right side wall of the crankcase 11 of the internal combustion engine 10 with a bolt 45 passed through a through hole 44*a* formed in the bracket 45. A pivot shaft 46*a* supporting a bell crank 46 is supported for rotation in bearings 47 in a vertical hole 44*b* formed in the bracket 44. A washer 48 is put on a lower end part of the pivot shaft 46*a*, and a snap ring 49 is engaged in an annular groove 46*b* formed in a lower part of the pivot shaft 46*a* to retain the bell crank 46 on the bracket 44. A ball-ended connecting member 46*d* is attached to the front arm 46*c* of the bell crank 46 so as to extend upward. A ball-ended connecting member 46*f* is attached to the rear arm 46*e* of the bell crank 46 so as to extend downward. The ball-ended connecting member 46*d* attached to the front arm 46*c* of the bell crank 46 is engaged in the socket of the socket-ended connecting member attached to the right end of the rod 42. The ball-ended connecting member 46*d* and the socket-ended connecting member 58 constitute a ball-and-socket joint.

Referring to FIGS. 8 to 11, a front end part 50*a* of a link 50 has substantially horizontal, parallel, flat upper and lower surfaces, and is provided with a socket 50*b*. The ball-ended connecting member 46*f* attached to the rear arm 46*e* of the bell crank 46 is engaged in the socket 50*b* of the link 50. A hole 50*c* is formed in a part of the link 50 on the front side of the socket 50*b*. The sockets 50*b* and 50*c* are connected by a slit 50*d*. A rear end part 50*e* of the link 50 has parallel right and left flat surfaces extending substantially along front and rear vertical planes. A socket 50*f*, a hole 50*g* and a slit 50*h* similar to those fanned in the front end part 50*a* are formed in the rear end part 50*e*. The ball-ended connecting member 46*f* attached to the rear arm 46*e* of the bell crank 46 is engaged in the socket 50*b* of the front end part 50*a* of the link 50 so form a ball-and-socket joint.

As shown in FIG. 6, a pivot shaft 44*c* projects rightward from a part, near the through hole 44*a* and the vertical hole 44*b*, of the bracket 44. An arm 51 is provided in the left side surface of a base part thereof with a cylindrical recess, not shown. The pivot shaft 44*c* of the bracket 44 is fitted in the cylindrical recess of the arm 51 to support the arm 51 for forward and backward turning. A holding bolt 52 passed through a through hole 51*a* formed coaxially with the cylindrical recess in the base part of the arm 51 is screwed in a center threaded hole 44*d* formed in the support shaft 44*c* of the bracket 44 to hold the arm 51 on the support shaft 44*c*. A ball-ended connecting member 51*b* is attached to a middle part of the right side surface of the arm 51 so as to project rightward. The ball-ended connecting member 51*b* is engaged in the socket 50*f* of the rear end part 50*e* of the link 50 to form a ball-and-socket joint. A washer 53 is loosely put on the holding bolt 52.

A connecting pin 54 is attached to the lower end of the arm 51 so as to extend rightward from the arm 51. A connecting member 70 is swingably mounted on a free end part of the connecting pin 54.

As shown in FIG. 2, a box 59 containing electrical equipment is disposed at a position above the right-hand side (on the left side as viewed in FIG. 2) of the internal combustion engine 10.

As shown in FIG. 3, a throttle operating Bowden cable 60 is connected to the throttle valve operating mechanism 40 to operate the throttle valve device 34. The throttle operating Bowden cable 60 has a flexible cable 61 for transmitting operating force applied to an operating handle placed in a ship, not shown, to the throttle valve operating mechanism 40, and a case 62 enclosing the cable 61. A bracket 55 for holding the throttle operating Bowden cable 60 is attached to the under cover 5 in a right part of the engine chamber 8. A holding pipe 63 having a neck 63*a* is put on a rear end part of the case 62, and the neck 63*a* is forced into a slot 55*b* formed in a standing part 55*a* of the bracket 55 to hold case 62 of the throttle operating Bowden cable 60 on the bracket 55.

A metal guide pipe 64 is connected to the rear end of the holding pipe 63. The joint of the holding pipe 63 and the guide pipe 64 is covered with a sealing member 65. The rear end 61*a* of the cable 61 is connected to the front end 66*a* of a connecting rod 66 in the guide pipe 64. The connecting rod 66 extends rearward from the guide pipe 64. A rear end part of the guide pipe 64 is covered with a sealing member 67. An exposed part, extending forward from the under cover 5, of the throttle operating Bowden cable 60 is covered with a rubber grommet 56 fitted in an opening 5*a* formed in the under cover 5.

Referring to FIG. 6, the connecting rod 66 has an externally threaded rear end part 66*a*. A locknut 68 is screwed on the externally threaded rear end part 66*a*. The externally threaded rear end 66*a* is screwed in an internally threaded hole 71*a* formed in a body 71 of the connecting member 70, and is fastened firmly to the connecting member 70.

A sliding cover 72 is mounted on the body 71 of the connecting member 70. The sliding cover 72 is able to slide longitudinally in a predetermined range. The connecting pin 54 attached to the lower end of the arm 51 is inserted in a hole 71*b* formed in the body 71 of the connecting member 70, and a slot 72*a* formed in the sliding cover 72. When the connecting rod 66 is pulled forward, the sliding cover, 72 slides forward relative to the body 71 by a predetermined stroke and thereby the connecting pin 54 is pulled forward and the arm 51 is turned forward. When the connecting rod 66 is pushed rearward, the connecting pin 54 engaged in the hole 71*b* of the body 71 is moved rearward and thereby the arm 51 is turned rearward.

Figure 7:
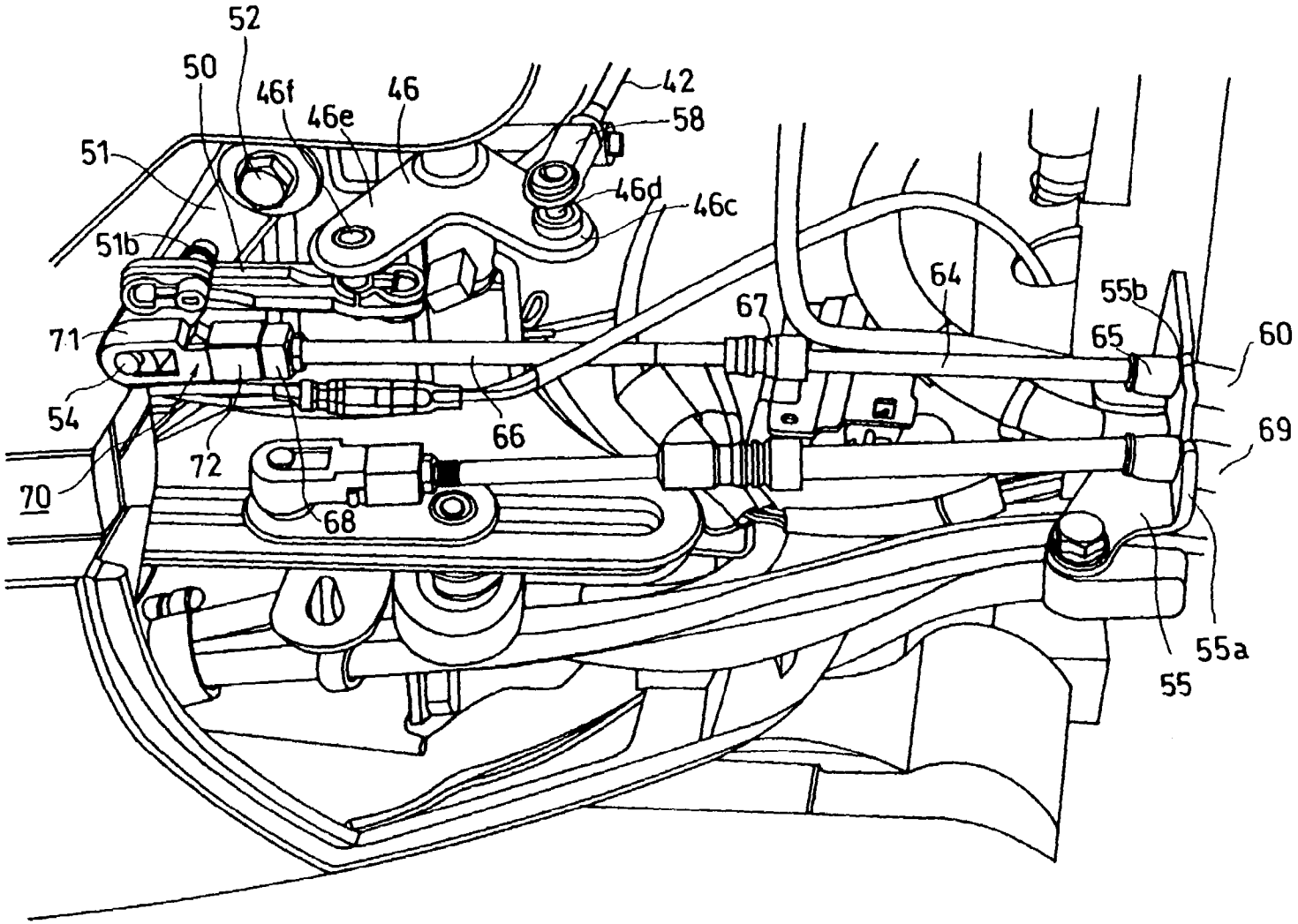
FIG. 7 is a perspective view of the throttle-operating mechanism shown in FIG. 6.
Figure 8:
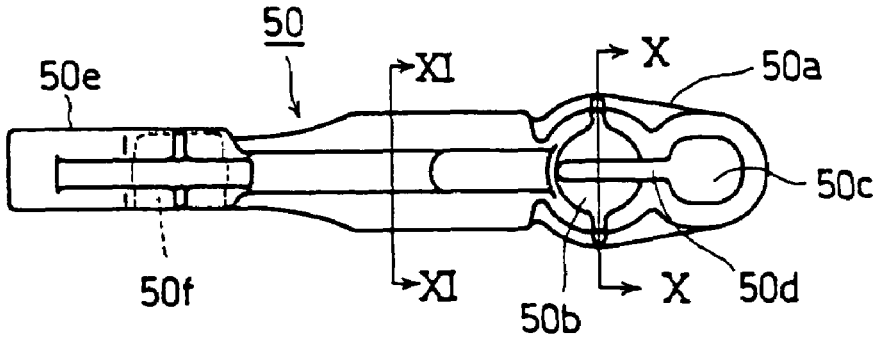
FIG. 8 is a plan view of a link.
Figure 9:
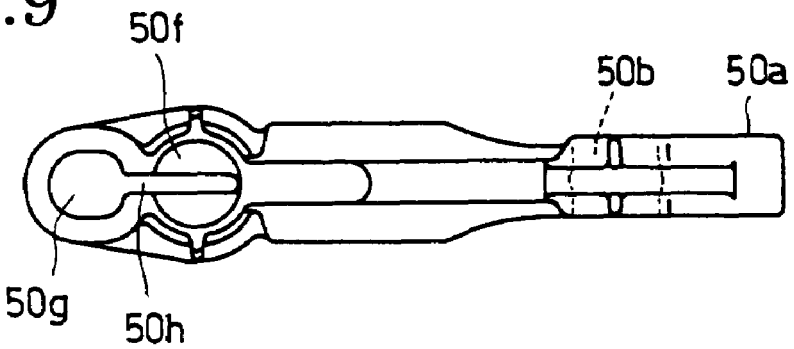
FIG. 9 is a plan view of the link shown in FIG. 8.
Figure 10:
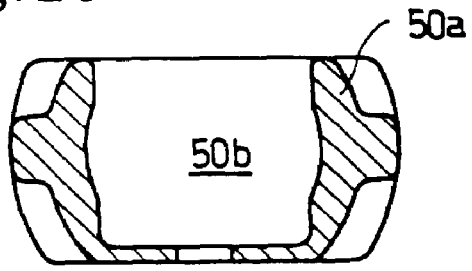
FIG. 10 is a cross-sectional view taken on the line X—X in FIG. 8.
Figure 11:
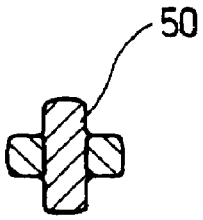
FIG. 11 is a cross-sectional view taken on the line IX—IX in FIG. 8.

Referring to FIG. 7, a shifting Bowden cable 69 for shifting a transmission is extended substantially parallel to the throttle operating Bowden cable 60 on the right side of the throttle operating Bowden cable 60. The shifting Bowden cable 69 is held on the standing part 55*a* of the bracket 55. When a crewman on board the ship pulls the throttle lever rearward to open the fully closed throttle valve device 34 of the outboard engine 1 embodying the present invention shown in FIGS. 1 to 12, the cable 61 of the throttle operating Bowden cable 60 is pulled forward. Consequently, the arm 51 having the lower end connected through the connecting member 70 and the connecting rod 66 to the rear end of the cable 61 is turned forward from a position shown in FIG. 4 through an angle of about 90° at a maximum to turn the bell crank 46 counterclockwise, as viewed in FIG. 3, through an angle of 90° at a maximum. Consequently, the connecting rod 42 is moved leftward (upward, as viewed in FIG. 3) to turn the operating lever 38 of the throttle valve device 34 counterclockwise, as viewed in FIG. 5, so that the fully closed throttle valve device 34 is opened. The angular position of the valve element 37 is measured by the throttle position sensor 57.

When the operating lever 38 is turned through an angle in an opening direction with the throttle valve device 34 in a nearly fully closed state, the valve shaft 36 and the valve element 37 turn through a very small angle as compared with an angle through which the operating lever 38 is turned, owing to the agency of the interlocking mechanism 39 interlocking the valve shaft 36 and the operating lever 38. Thus, the fine adjustment of the opening of the throttle valve device 34 is possible.

The cable 61 of the throttle operating Bowden cable 60 slides in a first direction, i.e., longitudinally, the rod 42 moves in a second direction, i.e., laterally to turn the operating lever 38 of the throttle valve device 34, and the operating lever 38 is connected to the connecting rod 66 connected to the rear end of the cable 61 of the throttle operating Bowden cable 60 by the throttle valve operating mechanism 40 including the connecting member 41, the rod 42, the bell crank 46, the link 50, the arm 51 and the connecting member 70. Although the first and second directions do not intersect, the second direction extends across the first direction when viewed in plan, as shown in FIG. 3. Therefore, even if the throttle valve device 34 is far off to the left from a rearward extension of the throttle operating Bowden cable 60, the operating force can be surely transmitted through the cable 61 to the operating lever 38 and the throttle valve device 34 can be smoothly opened and closed.

Since the bracket 55 holding the throttle operating Bowden cable 60 is spaced a long distance apart from the arm 51, and the rear end part of the throttle operating Bowden cable 60 is held on the bracket 55, and the holding pipe 63 and the guide pipe 64 are easily tiltable, the cable 61 is able to slide smoothly in the case 62 and the connecting rod 66 is able to slide smoothly in the guide pipe 64 regardless of the vertical shifting of the connecting pin 54 attached to the lower end of the arm 51 even if the arm 51 is turned through a large angle and the connecting pin 54 of the arm 51 is shifted vertically by a long distance.

Since the bell crank 46 can be freely turned in a three-dimensional space by the tilting motion of the operating lever 38 and the longitudinal turning of the arm 51, the swing motion of the arm 51 can be smoothly and surely transmitted to the operating lever 38.

As shown in FIGS. 3 and 4, the operating lever 38, i.e., a driven member of the throttle valve device 34, is disposed at the rear end of the throttle valve device 34, and the throttle position sensor 57 is disposed in front of the throttle valve device 34. Therefore, the valve shaft 36 of the throttle valve device 34 is short, and hence the throttle valve device 34 can be neatly disposed in the space defined by the engine cover 6 covering the internal combustion engine 10.

As shown in FIG. 4, the valve shaft 36 of the throttle valve device 34 is slightly inclined to a horizontal plane. Therefore, water does not collect in the bearing parts in which the valve shaft 36 of the throttle valve device 34 is supported and hence the throttle valve device 34 can be lightly operated.

The valve shaft 36 is inclined at an angle to a horizontal plane such that its front end is at a level higher than that of its rear end. Therefore, the operating lever 38 does not come into contact with the crankcase 11 when the valve shaft 36 is turned by the throttle valve operating mechanism 40 even though the operating lever 38 is disposed close to the front surface of the crankcase 11 of the internal combustion engine 10. Since the front surface of the throttle position sensor 57 is substantially parallel to the front wall of the engine cover 6 and a narrow gap is formed between the throttle position sensor 57 and the engine cover 6, the internal combustion engine 10 and the throttle valve device 34 can be neatly arranged inside the engine cover 6.

In the outboard engine 1 having the crankcase 11 disposed in the front part thereof and the cylinder head 13 disposed in the rear part thereof, the throttle valve device 34 is disposed in front of the crankcase 11, intake air flows from the left side (right side, as viewed in FIG. 2) of the outboard engine 1 through the throttle valve device 34 rightward, and the upstream end of the throttle valve device 34 is connected to the intake ports 18 formed in the cylinder head 13 by the intake manifold 23 as shown in FIG. 2. Therefore, the intake manifold can be formed in a very long length and hence the intake efficiency of the internal combustion engine 10 can be improved.

Although there has been described what is the present embodiment of the invention, it will be understood by persons skilled in the art that variations and modifications may be made thereto without departing from the spirit or essence of the invention. The scope of the invention is indicated by the appended claims.

What is claimed is:

1. An outboard engine comprising:

an internal combustion engine;

a throttle valve device for controlling intake air to be taken in by the internal combustion engine;

a driven unit combined with the throttle valve device;

a drive unit for producing a throttle-driving force corresponding to an external throttle-operating force applied thereto; and a throttle valve operating mechanism for transmitting the throttle-operating force of the drive unit to the driven unit;

wherein the throttle valve operating mechanism is a linkage including a plurality of component members, and the plurality of component members are joined by ball-and-socket joints.

2. The outboard engine according to claim 1, wherein the throttle valve device is disposed with a valve shaft thereof inclined to both horizontal vertical planes.

3. The outboard engine according to claim 2, wherein the throttle valve device is disposed such that the valve shaft slopes down from its front end toward its rear end.

4. An outboard engine comprising:

an internal combustion engine;

a throttle valve device for controlling intake air to be taken in by the internal combustion engine;

a driven unit combined with the throttle valve device;

a drive unit for producing a throttle-driving force corresponding to an external throttle-operating force applied thereto; and a throttle valve operating mechanism for transmitting the throttle-operating force of the drive unit to the driven unit;

wherein the throttle valve operating mechanism is a linkage including a plurality of component members joined by ball-and-socket joints; and wherein the component members include a swing arm pivotally supported so as to be turned by the throttle-operating force of the drive unit, a bell crank, a link connecting the swing arm to the bell crank to transmit the swing motion of the swing arm to the bell crank, and a first connecting rod for transmitting motions of the bell crank to the driven unit.

5. The outboard engine according to claim 4, wherein the swing arm, the bell crank and the link are supported on a single bracket.

6. The outboard engine according to claim 4, wherein a second connecting rod for transmitting the throttle-operating force of the drive unit to the arm is longitudinally extended, and the first connecting rod for transmitting the motions of the bell crank to the driven unit is laterally extended.

7. The outboard engine according to claim 6, wherein joints joining adjacent joining parts of the swing arm, the bell crank, the link and the respective first and second connecting rods are ball-and-socket joints, respectively.

8. An outboard engine comprising:

an internal combustion engine;

a throttle valve device for controlling intake air to be taken into the internal combustion engine;

a driven unit combined with the throttle valve device;

a drive unit for producing a throttle-driving force corresponding to an external throttle-operating force applied thereto; and a throttle valve operating mechanism for transmitting the throttle-operating force of the drive unit to the driven unit;

wherein the throttle valve operating mechanism comprises a cable connected to said drive unit to be driven in a first direction by the drive unit, and a linkage connecting the cable to said driven unit of the throttle valve, said linkage including a rod connected to said driven unit and extending in a second direction across said first direction of the cable, and said linkage is made up of a plurality of component members which are mutually joined by ball-and-socket joints.

9. The outboard engine according to claim 8, wherein said second direction of the rod of the linkage is transverse to said first direction of the cable.

10. The outboard engine according to claim 8, wherein said first direction is a longitudinal direction of a ship on which the outboard engine is mounted, and said second direction is a lateral direction of the ship.

* * * * *